US009140026B2

(12) United States Patent
Barnett et al.

(10) Patent No.: US 9,140,026 B2
(45) Date of Patent: Sep. 22, 2015

(54) TELESCOPIC PUMPABLE PROPS

(71) Applicant: Cougar Can Company Pty Ltd., Mackay (AU)

(72) Inventors: Craig Douglas Barnett, Mackay (AU); Phillip Martin Pike, Mackay (AU)

(73) Assignee: Cougar Can Company Pty Ltd., Mackay (AU)

( * ) Notice: Subject to any disclaimer, the term of this patent is extended or adjusted under 35 U.S.C. 154(b) by 0 days.

(21) Appl. No.: 14/200,187

(22) Filed: Mar. 7, 2014

(65) Prior Publication Data

US 2015/0097099 A1 Apr. 9, 2015

Related U.S. Application Data

(63) Continuation-in-part of application No. 13/753,666, filed on Jan. 30, 2013, now abandoned, and a continuation of application No. PCT/AU2011/000919, filed on Jul. 21, 2011.

(30) Foreign Application Priority Data

Aug. 2, 2010 (AU) ..... 2010903431
Dec. 17, 2010 (AU) ..... 2010257264

(51) Int. Cl.

| | |
|---|---|
| ***E21D 15/14*** | (2006.01) |
| ***E04G 25/04*** | (2006.01) |
| ***E21D 15/44*** | (2006.01) |
| ***E21D 15/45*** | (2006.01) |
| ***E21D 15/48*** | (2006.01) |

(52) U.S. Cl.

CPC ..... *E04G 25/04* (2013.01); *E21D 15/44* (2013.01); *E21D 15/445* (2013.01); *E21D 15/45* (2013.01); *E21D 15/48* (2013.01); *E21D 15/483* (2013.01); *E21D 15/486* (2013.01); *E04G 2025/047* (2013.01)

(58) Field of Classification Search

CPC ..... E02D 27/48; F16L 37/26
USPC ..... 405/272, 288–294; 285/325
See application file for complete search history.

(56) References Cited

U.S. PATENT DOCUMENTS

| | | | | |
|---|---|---|---|---|
| 653,143 | A * | 7/1900 | Martin | 285/67 |
| 823,346 | A * | 6/1906 | Maxwell | 285/325 |
| 4,185,940 | A * | 1/1980 | Spies | 405/288 |
| 5,263,796 | A | 11/1993 | de Waal | |
| 5,273,378 | A | 12/1993 | Merz et al. | |
| 5,484,130 | A | 1/1996 | Domanski et al. | |
| 5,547,313 | A | 8/1996 | Holland | |
| 5,921,718 | A | 7/1999 | Kolk | |
| 6,394,707 | B1 * | 5/2002 | Kennedy et al. | 405/288 |
| 7,618,070 | B2 * | 11/2009 | Stoll et al. | 285/305 |

* cited by examiner

*Primary Examiner* — Sean Andrish
(74) *Attorney, Agent, or Firm* — Scherrer Patent & Trademark Law, P.C.; Stephen T. Scherrer; Monique A. Morneault

(57) ABSTRACT

A grout fillable prop has an inner member and an outer member adapted for movement between an extended use position and a retracted position. A grout inlet is formed in an upper part of a sidewall of the outer member to allow grout to pass into the prop. The inner member and the outer member have wall portions with plastic properties and are self-supporting. An installation fitting is fitted to the grout inlet and adapted to hold a grout filling tool without the use of separate fasteners. A one way valve is fitted to the installation fitting. The one way valve is formed of a length of lay flat hose one end of which is attached to the installation fitting. The hose locates inside the prop when the installation fitting is attached to the prop.

13 Claims, 11 Drawing Sheets

TELESCOPIC PUMPABLE PROPS

CROSS-REFERENCE TO RELATED APPLICATIONS

This application is a continuation-in-part of U.S. patent application Ser. No. 13/753,666 filed on Jan. 30, 2013, which is a continuation of PCT/AU2011/00919, filed Jul. 21, 2011, which claims priority to Australia Patent Application No. 2010903431, filed Aug. 2, 2010, and Australia Patent Application No. 2010257264 filed Dec. 17, 2010.

TECHNICAL FIELD OF THE INVENTION

The present invention is directed to improvements in relation to telescopic props that can be filled (pumped) with grout and which has particular use in underground mining. There may be circumstances where the props may have uses in areas other than underground mining, such as house stumps. The improvements include increasing the load bearing ability, improved and safer filling of the prop with grout, reducing the prop weight to enable two men to erect the prop without lifting machinery, and reducing the prop cost.

BACKGROUND OF THE INVENTION

The discussion of any prior art documents, techniques, methods or apparatus is not to be taken to constitute any admission or evidence that such prior art forms, or ever formed, part of the common general knowledge.

Pumpable props are elongate hollow members that can be filled (pumped) with a settable material such as grout to form a strong load bearing column. It is known for these props to be length adjustable.

A known type of pumpable prop is a pumpable crib bag, and an example of this is described in U.S. Pat. No. 8,246,276. These props typically comprise a long cylindrical bag, sometimes containing external reinforcement. The bag is extended, fixed to the mine roof and then filled with grout. The US patent acknowledges the expense of existing crib bags and the difficulty in installation. The patent also acknowledges the relatively low load supporting properties of this type of prop and improves upon the prop by including an internal reinforcement which is embedded in the grout. While this can improve the load supporting properties of the pumpable crib bag type prop, it also increases the cost of this type of prop, and may make the filling of the prop more difficult. Bag type props generally have spaced wire hoops or a spiral wire reinforcement to permit collapsibility of the bag.

Another type of suitable prop is described in U.S. Pat. No. 5,273,378 (Merz). This prop is height adjustable and can be filled with a settable grout. The prop is made from steel segments.

The ability of grout filled props to withstand loads is determined by compressing the prop to the point of failure. As the prop is compressed, the grout, at some stage, begins to fracture. As long as the fractured grout is retained within the prop and the prop generally remains upright, the prop will retain a load bearing ability and not fail. This simulates movement in the mine roof. At some stage the prop wall will split causing the fractured grout to spill from the prop and at this stage the load bearing ability of the prop fails. With the bag type columns, it is found that compression of a 750-800 mm diameter 2.5 m high column by less than 200 mm will cause the bag to split, the grout to spill, and the column to fail. Put differently, should a mine roof collapse more than 200 mm, the bag type column will no longer be able to support the mine roof.

Somewhat surprisingly, it is also found that a column made of steel tubes filled with grout is also not very effective. It is found that compression of a 600 mm diameter 2.5 m high steel column by about 300 mm causes the column to fail. While a steel column is much stronger than a bag type column, it is found that compression (that is vertical displacement) of the column causes the column to "kink" which forms a line of weakness in the metal and which causes the metal to split. The kink configuration also results in the column adopting a non-linear configuration which makes bursting of the column much easier. Put differently, a roof collapse of more than 300 mm can cause a grout filled steel column to fail.

Another disadvantage with existing grout filled props is the amount of labor required in the erection. The bag type column requires the extended bag to be secured somehow to the roof of the mine to keep it in the upright condition while being filled with grout. The attachment and removal of the grout filling tool can also be laborious. The metal type column is very heavy and the inventors consider that the metal type column as described in the above US patent (Merz) would require five men and a small crane or forklift truck for erection. Installing a multiplicity of Merz props would be very time consuming and laborious.

A further problem is that it is often difficult and labor intensive to install a prop in a mine. This is because the roof and floor of the mine may be uneven so that it is difficult to maneuver the prop and locate it in its desired position.

Another disadvantage with existing fillable props is the difficulty and time taken to attach and remove the grout filling tube to the prop. Most existing fillable props are filled from the top of the prop. The reason for this is that it enables grout to be used with a faster gel time. A prop filled from the bottom requires grout to have a longer gel time to prevent the grout from setting before the prop is filled. If the mine roof is more than about 2 meters high, a ladder is required to enable a person to attach the grout line to the grout inlet on the prop. When the prop is filled, the person again needs to use a ladder to remove the grout line from the now filled prop. In a muddy, wet and slippery mine, climbing a ladder is hazardous.

Another disadvantage with existing fillable props is the tendency for grout to spew back out of the inlet when the prop is full and the grout filler tube is removed. Some props are fitted with a one way valve but these valves can be quite flimsy and are not entirely reliable. Other props use expensive ball type valves that add to the cost of the prop as the valve usually stays on the prop and is not reused. If grout spews back out of the inlet, a void is created in the column which creates a zone of weakness. There would be an advantage to provide a fillable prop with an inexpensive yet reliable backflow prevention valve.

It is an object of the present invention to address one or more of the above-described problems or to at least provide a useful alternative to those props and stays that have hitherto been known in the prior art.

SUMMARY OF THE INVENTION

According to a first aspect of the present invention there is provided a prop comprising an inner member and an outer member adapted for movement between an extended use position and a retracted position, a grout inlet to allow grout to pass into the prop, the inner member and the outer member having wall portions with plastic properties.

While not wishing to be bound by theory, it appears that the plastic properties of the wall portions in the inner member and the outer member can accommodate a much greater degree of compression of the prop before failure. In a nonlimiting example, it is found that a prop manufactured in accordance with the present invention can be compressed (vertically displaced) by more than 500 mm (over half a meter!) while still able to support a load. Thus, this type of prop is much better able to support a roof collapse. Again, while not wishing to be bound by theory, it seems that the plastic properties of the wall portions can accommodate the fracturing grout without the wall portions splitting or bursting or otherwise opening up to enable the grout to spill from the prop causing the prop to fail.

Suitably the grout inlet is in the outer member and preferably in an upper part of a sidewall of the outer member.

The inner member and the other member may be entirely comprised of material with the plastic properties.

The term plastic properties is meant to include that the wall portions have a degree of stretch and bending ability. If the entire member comprises material with the plastic properties it is preferred that the member is also self supporting and does not collapse under its own weight.

The inner member and the outer member may be formed from plastics material or other material with the desired plastic properties. Various plastic materials may be suitable including plastics materials used in rotational moulding and injection moulding applications. These may include thermoplastics such as polyethylenes, polypropylenes, hexene copolymers, linear low density polyethylene, nylons, polyvinyl chlorides, acrylics. A non-limiting example of a suitable plastic is MOCROLENE M11 UV R02 manufactured by Martogg & Company, Australia.

The inner member and the outer member may comprise zones of different materials or different plastic properties. Thus, there may be circumstances where it is desirable for the members to comprise non-deformable wall portions and plastic wall portions. This may be desirable to enable the compression of the prop to be regulated. However, it seems convenient to manufacture the inner member and the outer member of the same materials.

The inner member and the outer member can extend and retract relative to each other. In one form, each member is substantially cylindrical and can slide telescopically relative to each other. However, it is envisaged that the members may also comprise square or rectangular cross-sections that can slide relative to each other. This latter alternative may be suited if it is desirable for the members to extend and retract relative to each other without any rotation.

Suitably, the prop comprises a single inner member and a single outer member such that the prop comprises two pieces. However, there may be circumstances where it is desirable for the prop to have three or more pieces that can slide relative to each other. Alternatively, the prop may comprise the inner member and the outer member and may further comprise a non-telescopic fixed member that can be used, for instance, as an additional spacer member. This additional member may be filled with grout if desired and may comprise a separate piece that can be attached or otherwise operationally associated with the inner member or the outer member.

The length of each prop member may vary to suit. Suitably, each prop member is substantially of the same length. However there may be circumstances where it is desirable for one member to have a length different to the other member. It is considered desirable that the prop, when in the extended position, can have a length of between 3-6 m and preferably between 3-5 m and typically between 3.6-4 m. In the retracted position, the prop will typically have a length of approximately half the length of the extended position. In the preferred extended length of between 3.6-4 m, the retracted length of the prop will typically be about 2 m which is a length convenient for transportation of the prop into a mineshaft in a quick and easy manner. It should however be appreciated that no unnecessary limitation is to be placed on the invention merely by the exemplification of certain lengths.

The diameter of the prop (if the prop is cylindrical) may vary to suit. A suitable diameter of the prop will be between 400-1500 mm and preferably between 800-1200 mm and most preferably about 900 mm. Again, no unnecessary limitation should be placed on the invention merely by the exemplification of certain diameters.

The wall thickness of the inner member and the outer member may vary to suit. Suitably, the inner member and the outer member have approximately the same wall thickness. If the inner member and the outer member are made of plastics material, a wall thickness of between 2-5 mm is considered suitable and typically between 3-4 mm. This will of course depend on the type of plastics material. The end wall of each member may be made of stronger thicker material and, as an example only, the end wall may be approximately 10 mm thick. The wall thickness and the materials chosen is preferably such that the inner member and the outer member are self-supporting.

The weight of the prop (without grout) is preferably such that the prop can be lifted by two people. An advantage of the present invention is that the prop can have a weight of typically between 30-70 kg and, typically about 55 kg for a prop of a typical extended length (3 to 4 m) and a typical diameter (approximately 900 mm). In contrast, a metal prop (without grout) will be much heavier.

By having the inner member and the outer member made in a self-supporting manner, the prop has an advantage over the "bag" props where the bag is not self-supporting when in the extended position. If desired, the inner member and/or the outer member may include other strengthening or stiffening parts which may include ribs, gussets, cross members and the like. This may enable the prop to retain sufficient stiffness to be relatively self-supporting while being sufficiently light to be carried by two workers.

Suitably, the outer member has a top wall which contains an opening adapted to accommodate a roof bolt or other type of projection in the mine roof. In this manner, the prop can be extended and "anchored" to the roof bolt (or other type of projection) and when the prop is filled with grout the roof bolt can be embedded in the grout. The opening may be of any suitable size and shape and may include a circular opening, a slot like opening, a rectangular opening, an opening of irregular shape, a plurality of openings and the like. It is also envisaged that the top wall may be formed with an impression or frangible part or other type of profile that can be removed or knocked out to provide the opening.

It should be appreciated that there will be circumstances where a roof bolt or similar is not used or is not present.

It is also envisaged that the outer member may be connected to some form of attachment and which contains a profile adapted for engagement with the mine roof or some part of the mine roof. The attachment may comprise a separate part which can be attached by any suitable means to the outer member and typically to, or over, the top wall of the outer member. In an example, the top of the outer member may comprise a flexible envelope fast with the one or more sides of the outer member for receiving filling in order to present a deformable upper surface for bearing a load. In this embodiment, the flexible envelope can be filled with the grout being pumped into the prop and this can be achieved by having some form of communication opening between the prop and the flexible envelope. The communication opening may comprise the opening that may be present in the top wall of the outer member and which is otherwise adapted to accommodate a roof bolt.

The grout material may comprise any suitable settable substantially non-compressible material. This may include high strength grouts, high strength thixotropic grouts, fibre reinforced grouts, two component grouts and the like. The grout material may be in the form of a powder which is mixed with water. A relatively fast gel grout is preferred to give load supporting properties to the prop as quickly as possible. A gel time (20 degrees Celsius) of between 3-15 minutes is suitable and a preferred gel time is between 4-7 minutes. A non-limiting suitable grout is CMT Grout 1:1 water/powder ratio manufactured by Minova Australia.

In a preferred embodiment of the invention the prop is formed with air holes in the top to allow air to escape the vessel whilst the material is being inserted therein.

Handles may be provided for easy carrying and to assist in extending the cover from the base to a desired height.

Stops may be provided on the sides of the outer member and of the inner member which cooperate to prevent the outer member from being inadvertently disengaged from the base.

Preferably the stops may be overcome by rotating the inner member relative to the outer member in order to remove the outer member from the inner member to thereby empty the vessel of the material.

As an alternative to, or in addition to the stops, markings or protrusions or the like may be located upon the side of a portion of the prop to provide a visual indicator as to when the limit of extension of the vessel is approaching or has been reached.

In some embodiments the markings may be provided in the form of one or more stickers or decals that are applied to one or more portions of the prop.

The prop contains a grout inlet. Suitably, the inlet comprises a separate installation fitting which is fitted into a suitable opening in the outer member and typically in a top part of the outer member such that the prop is filled from the top. The installation fitting is suitably attached in a quick and easy manner and preferably without the use of any fasteners. Thus, in one form, the installation fitting may comprise a circumferential or peripheral rib, extension, shoulder, wall, flange and the like which can lock the fitting to the side wall of the outer member. In a simple manner, the rib etc. can be deformed as the fitting is pushed through the opening and then can return to its original configuration to lock the fitting to the side wall. In a variation, the fitting may be provided with some form of screw thread that can be threaded into position. Other forms of attachment may be envisaged which may include snap lock attachments, twist lock attachments and the like.

The installation fitting may be provided with attachment means to enable a grout filling tool to be attached to the installation fitting in a simple yet reliable manner. The attachment means may comprise a guide channel.

Suitably, a non-return means/one-way valve and the like is provided to prevent grout from spewing out of the installation fitting after the prop has been filled. Suitably, the one-way valve comprises a flexible tubular member. A suitable flexible tubular member may comprise a lay flat hose. The hose may be attached to the installation fitting and, in use, locates within the confines of the prop. As the prop is filled with grout, grout can flow through the hose and into the prop and when the grout filling tool is removed, the pressure in the prop can squeeze the hose flat and therefore in a sealed condition. The hose may have any suitable length and it is considered that a width of between 50-200 mm and a length of between 50-200 cm will be suitable.

The installation fitting may be provided with a guide/key/dowel to ensure that the fitting is attached to the side wall of the inner member in the correct orientation. This will be described in greater detail below.

Suitably, a grout filling tool is provided. The grout filling tool may comprise an elongate substantially rigid tubular member. One end (typically a lower end) can be attached to a grout filler hose. The other end (typically the upper end) can contain a coupling to enable the tool to be easily fitted to the installation fitting. The coupling may comprise a key which can fit inside the installation fitting to couple the tool to the installation fitting. Suitably, the tool can be removed from the installation fitting by lifting the tool out of the installation fitting. Suitably, the rigid tubular member is of sufficient length to enable a person on the ground to position the tool to the installation fitting (the installation fitting may be 3-4 m above ground). Thus, in this manner a ladder (and hazards associated with the ladder) need not be required.

Suitably, a restraining means is provided to hold the prop in place when the prop is in the extended use position and prior to filling with grout. The restraining means may comprise adhesive tape that can be wound about the prop at the junction of the inner member and the outer member. Alternatively, attachments may be used. An advantage of adhesive tape is that the tape may also reduce grout forcing its way out of the prop between the inner member and the outer member. The adhesive tape may be removed after the prop is filled or may simply stay in place.

BRIEF DESCRIPTION OF THE DRAWINGS

Preferred features, embodiments and variations of the invention may be discerned from the following Detailed Description which provides sufficient information for those skilled in the art to perform the invention.

The Detailed Description is not to be regarded as limiting the scope of the preceding Summary of the Invention in any way. The Detailed Description will make reference to a number of drawings as follows.

DETAILED DESCRIPTION

Figure 1:
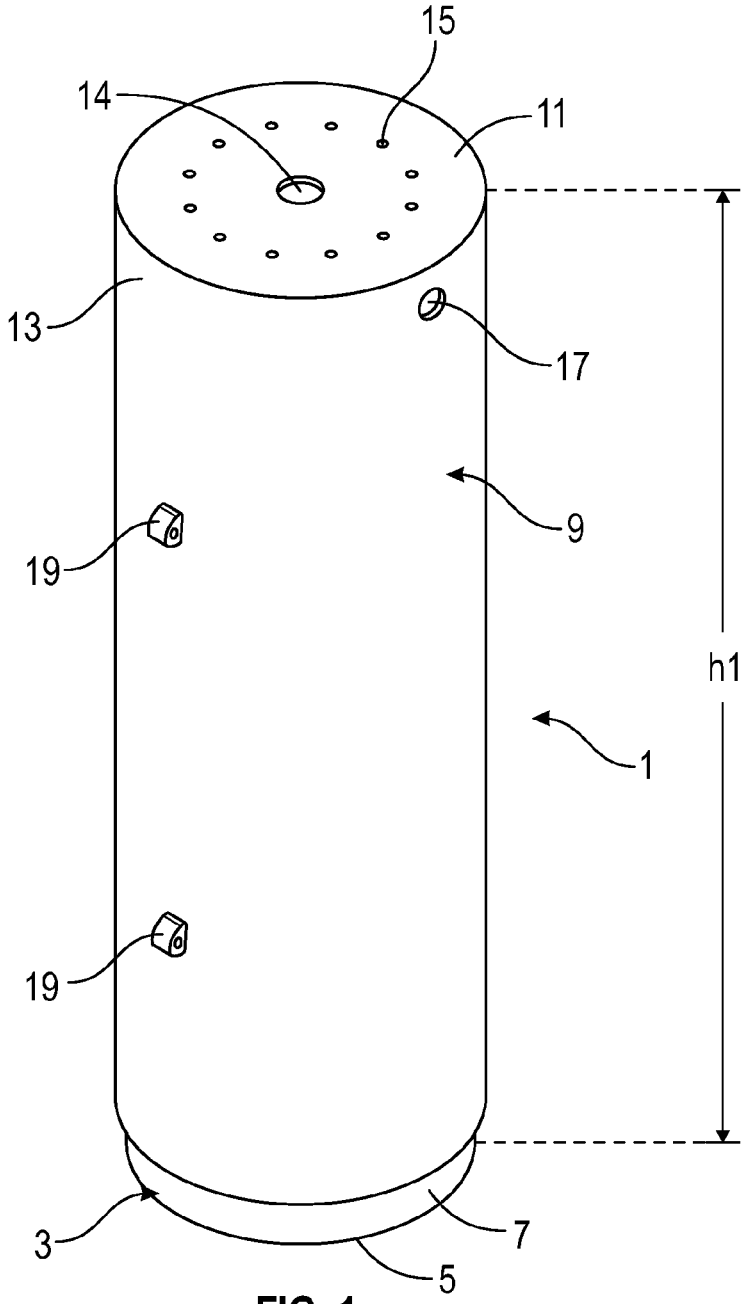
FIG. 1. Illustrates a prop according to a preferred embodiment of the invention in a collapsed configuration.

Referring now to FIG. 1 there is depicted a prop 1 according to preferred embodiment of the present invention in a retracted (collapsed) configuration. The prop 1 comprises an inner member 3 (see FIG. 2) having a bottom wall 5 and a side wall 7 over which there is located an outer member 9 or cover having a top wall 11 and a side wall 13.

It will be seen that the side wall 13 of outer member 9 substantially overlaps the side wall 7 of inner member 3 so that the overall height of the prop in the collapsed state shown in FIG. 1 is h1 as indicated. The top wall 11 of outer member 9 includes an opening 14 for locating with a roof bolt of a mine for example, once installed. Opening 14 is in the central portion of top wall 15 which means that when a roof bolt (or some other protrusion) passes into opening 14, it will become embedded in the grout once the grout has been pumped into the prop. By having opening 14 in a central part of top wall 15, the roof bolt will be embedded in a central part of the prop which provides a stronger join.

Air holes 15 are suitably formed through top wall 11. The air holes 15 allow air to escape as grout is pumped into the prop. The air holes 15 may be spaced inwardly by some distance from the peripheral edge of the top wall. The number, arrangement, shape and size of the holes can vary depending on site requirements.

A grout inlet 17 is formed through side wall 13 of the cover to receive substantially non-compressible filler such as concrete or grout. Inlet 17 is located in an upper part of the side wall 13 of outer member 9. Inlet 17, in the particular embodiment, comprises a through hole and is adapted to receive an installation fitting 30 which will be described in greater detail with reference to FIGS. 4-10.

The inner member 3 and outer member 9 have wall portions with plastic properties and in the particular embodiment, the entire inner member and the entire outer member is made of the same plastic material. Various plastic materials are envisaged to provide plastic properties to the sidewalls 7, 13 of the inner member and the outer member. These plastic materials may include thermoplastics such as polythenes and particularly polyethylenes and polyhexenes. In the particular embodiment, the inner member 3 and the outer member 9 comprise a linear low density polyethylene such as MOCROLENE M11 UV R02 manufactured by Martogg & Company, Australia.

The side wall 7 of inner member 3 can have a thickness of about 3.5 mm. The bottom wall 5 has a thickness of about 10 mm and the side wall which is immediately above bottom wall 5 has a thickness of about 6 mm. This thicker band portion has a width of approximately 10-40 cm. The reason for this will be described in greater detail below.

Each member substantially identical in construction and therefore outer member 9 also has a side wall thickness of about 3.5 mm, a top wall thickness of about 10 mm and the 6 mm thicker side wall band immediately below the top wall. Of course, the inner member will have a slightly smaller diameter to the outer member to enable the inner member to slide inside the outer member between the retracted position and the extended position.

This arrangement provides sufficient rigidity and strength to the inner member and the outer member to enable the members (and therefore the prop) to be self-supporting and not to simply collapse under its own weight prior to grout being pumped into the prop. The 6 mm thicker side wall coincides with grout inlet 17 which means that the wall defining inlet 17 has a thickness of 6 mm this making it more suitable for attachment by the installation fitting 30 which will be described in greater detail below.

In this particular embodiment, each member has a length of approximately 2 m and a diameter of about 900 mm. When extended (see FIG. 2) there will be an overlap between the upper end of the inner member 3 and the lower end of the outer member 9, and this overlap will be about 800 mm. The overlap prevents unnecessary amounts of grout spewing out of the prop between the inner member and the outer member.

Figure 2:
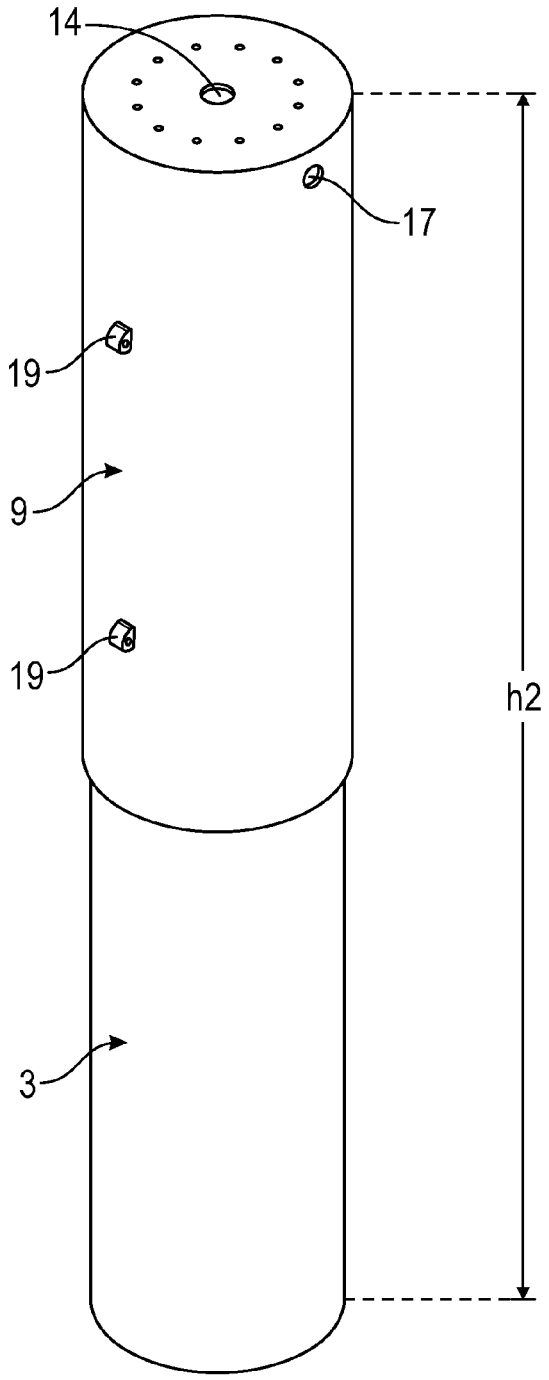
FIG. 2. Illustrates the prop of FIG. 1 in an extended configuration.

Referring now to FIG. 2, once the empty prop 1 has been transported to its site for installation the outer member 9 is raised with use of handles 19 (see FIG. 3) so that the overlap of the sides of the base with the sides of the cover is substantially reduced. In this extended configuration a filler such as concrete or grout is introduced into the prop through grout inlet 17. The cover can be extended so that the distance from the top wall 11 to the bottom wall 5 is h2 as indicated in FIG. 2. In the extended form the opening 14 at the top of the prop can be located about a structure protruding from the ceiling such as a roof bolt.

It will be realised that the presence of the opening 14 makes it much easier to locate the prop since it can take advantage of existing features in the environment in which it is to be installed, such as roof bolts in a mine for example.

Preferably stops (not visible) are provided on the sides of the cover and the base which cooperate to prevent the cover from being inadvertently extended so far that it becomes disengaged from the base. The stops may be overcome by rotating the base relative to the cover in order to remove the cover from the base to thereby empty the vessel of the material and all it to be returned to a collapsed state if required.

As an alternative to, or in addition to, the stops, markings or protrusions or the like may be formed upon the side of a portion of the vessel to provide a visual indicator as to when the limit of extension of the vessel is approaching or has been reached. In some embodiments the markings may be provided in the former of one or more stickers or decals that are applied to one or more portions of the vessel.

Figure 3:
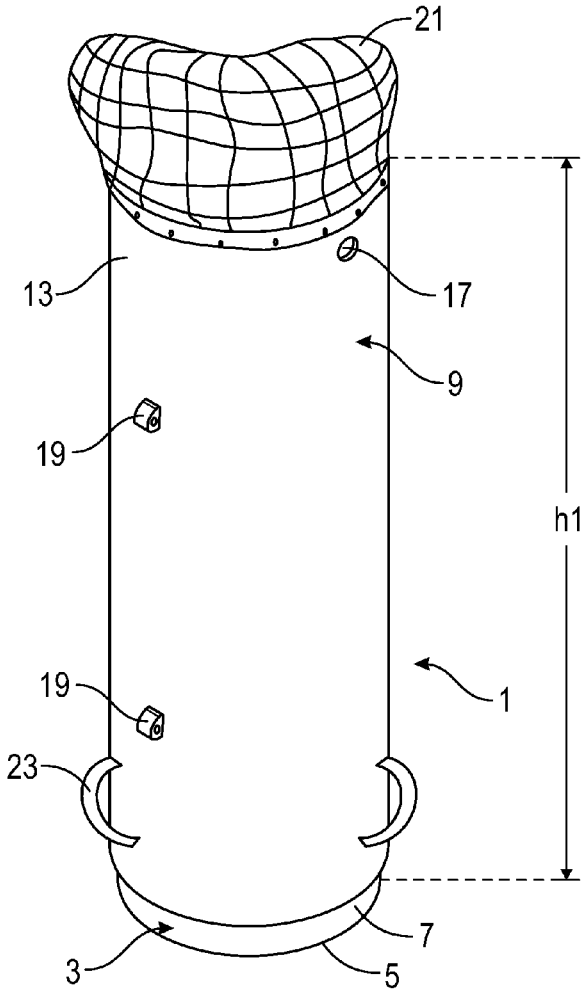
FIG. 3. Illustrates a further embodiment of a prop according to the present invention.

Referring now to FIG. 3, in a further embodiment of the invention a flexible envelope such as a bag 21 may be screwed around the top of the prop. The bag may be made of plastic, rubber or a flexible mesh with relatively fine gaps for retaining filling. During use the filling that is pumped into the prop under pressure will initially fill the prop, and then further pumping of grout will cause the grout to pass through opening 14 and into bag 21 thereby filling it. In turn the bag 21 presents a deformable upper surface that is able to conform to any inconsistency or shape of the roof to thereby allow for a stronger seal and better support of the roof. This is desirable because the roof is rarely flat.

Additionally, handles 23 may be provided on the sides of the prop. In an alternative embodiment these may be molded into the lower part of the cover portion 9 during manufacture.

Reference will now be made to the improved filling of the prop, and in particular reference will be made to FIGS. 4-10. Referring initially to FIG. 8, there is illustrated an installation fitting 30. Installation fitting 30 comprises an outer head portion 31, and an inner body portion 32. Body portion 32 is designed to be pushed into and through the grout inlet 17 (see for instance FIG. 2) on the outer member 9. Body portion 32 contains a peripheral locking barb 33 best illustrated in FIG. 9 and FIG. 10. As the body portion 32 is pushed through inlet 17, the peripheral locking barb 33 will initially be deflected and will then return to its extended position where barb 33 sits behind the inside wall of the outer member 9 thereby locking the installation fitting 30 in position.

It is also important that installation fitting 30 is attached in the correct orientation to outer member 9. To achieve this, the body portion 32 further includes a fin 34. The inlet 17 while being circular, also contains a small vertical slit 35 (see FIG. 2) into which fin 34 can pass. This ensures that the installation fitting is installed in the correct orientation as it is pushed into a "snap lock" engagement with the outer member 9.

Figure 4:
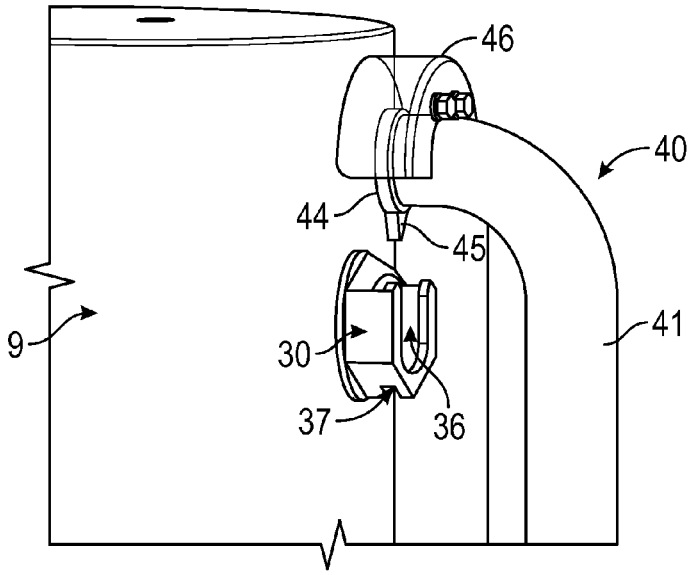
FIG. 4. Illustrates part of the outer member with the installation fitting in place and the grout filling tool about to be positioned into the installation fitting.

The outer head portion 31 of the installation fitting contains a somewhat U-shaped slotted guide 36 or channel 36 (see also FIG. 4). A lower portion of the guide is formed with an opening 37.

Figure 11:
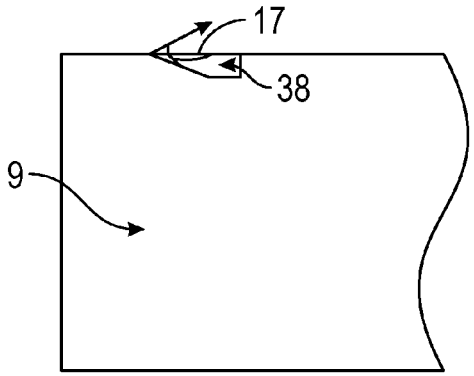
FIGS. 11-12. Illustrate attachment of the installation fitting to the outer member.
Figure 12:
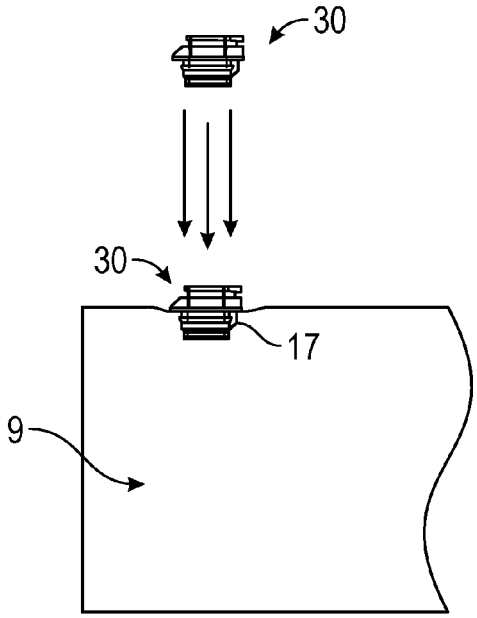

Referring to FIGS. 11-12, in use, the outer member 9 contains the grout inlet 17 which is initially taped over by a removable tape 38 to prevent dirt and debris from entering into inlet 17 and also to prevent the inlet from being damaged. The prop (comprising the outer member 9 and the inner member 3) is carried by two workers into the required position and while the prop is in the collapsed state. It should be appreciated that by being made of relatively thin plastic material, a prop comprising two lengths slightly over 2 m long and about 900 mm in diameter will weigh approximately 55 kg and can be quite easily carried by two workers. At this stage, the prop does not contain the installation fitting which means that there is no possibility of damage to the installation fitting as the prop is being carried into position or stored etc.

When the prop is in the desired position, the installation fitting 30 is snap locked into its correct orientation through inlet 17 and in the manner described above and with reference to FIG. 12.

Figure 13:
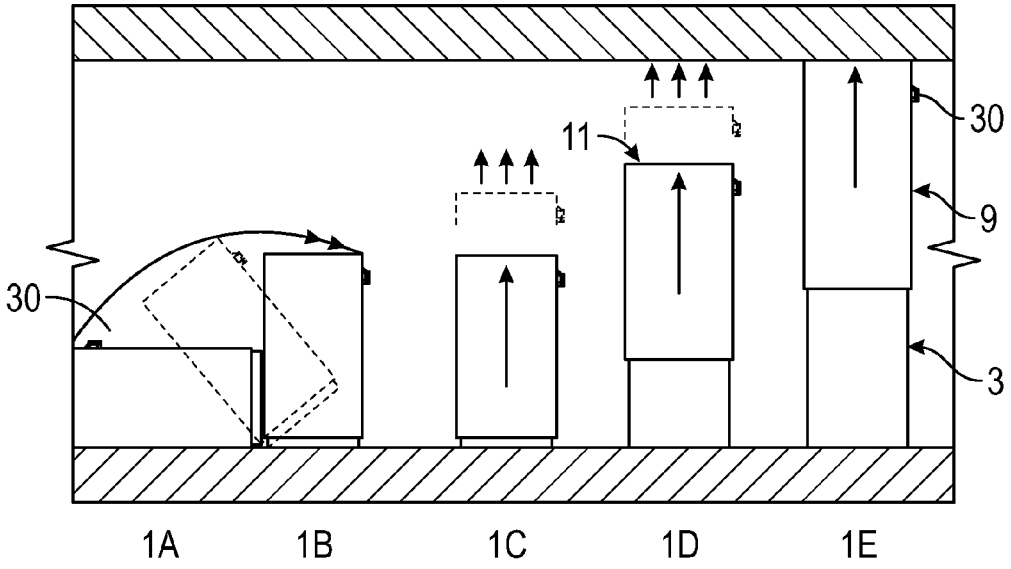
FIG. 13. Illustrates sequential erection of the prop in a mineshaft.

Referring now to FIG. 13, once the installation fitting 30 has been placed on the prop 1A, the prop can then be lifted from the horizontal collapsed state (1A) to the vertical collapsed state (1B). Then, two men (not illustrated) can raise the outer member 9 (1C-1E) until the top wall 11 of the outer member is against the mine roof. At this stage, an adhesive tape (duct tape) 39 (see FIG. 14) can be taped about the join between the lower end of the outer member 9 and the upper end of the inner member 3. The adhesive tape will prevent the outer member 9 from sliding down and the adhesive tape can also prevent grout from spewing out of this join area when the prop is being filled.

The outer member 9 and the inner member 8 while being made of relatively thin plastic material are still self-supporting and therefore will not simply collapse as may be the case with the bag type props. Also, because of the same properties, duct tape is sufficient to hold the two parts in the extended position which would not be the case if the outer member 9 and the inner member 3 were made of heavy steel tubes. Of course, other types of temporary attachments could be used.

Figure 14:
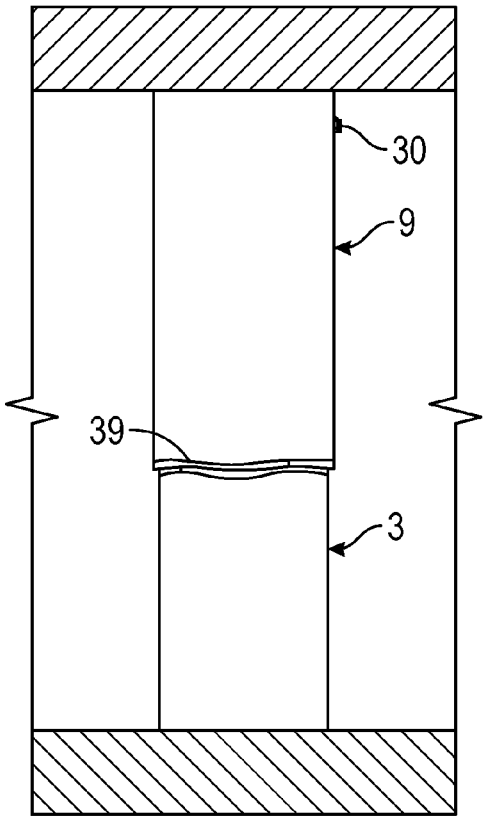
FIG. 14. Illustrates the use of a restraining member in the form of adhesive tape about the prop.

Referring to FIG. 13 and FIG. 14, the prop is now in the extended but as yet unfilled position and the installation fitting 30 is in an upper part of the prop and it should be appreciated that depending on the height of the mine, the installation fitting could be 3 or 4 m above ground level.

Another feature or improvement of the present invention enables the prop to be filled with grout by a worker standing on the ground and therefore not needing to use a ladder to attach and remove the grout filling pipe from the installation fitting.

Figure 5:
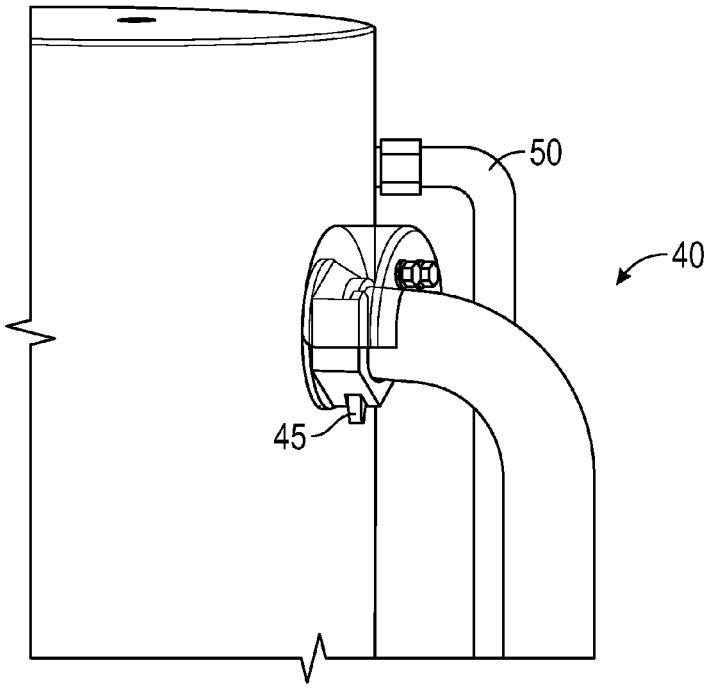
FIG. 5. Illustrates the arrangement of FIG. 4 with a grout filling tool having been lowered into engagement with the installation fitting to enable grout to be pumped into the prop.
Figure 6:
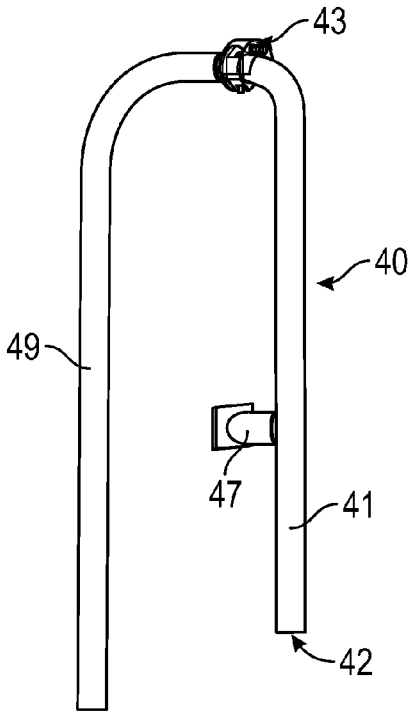
FIG. 6. Illustrates the grout filling tool attached to the installation fitting and the one-way valve attached to the installation fitting (the outer member having been removed for clarity).
Figure 7:
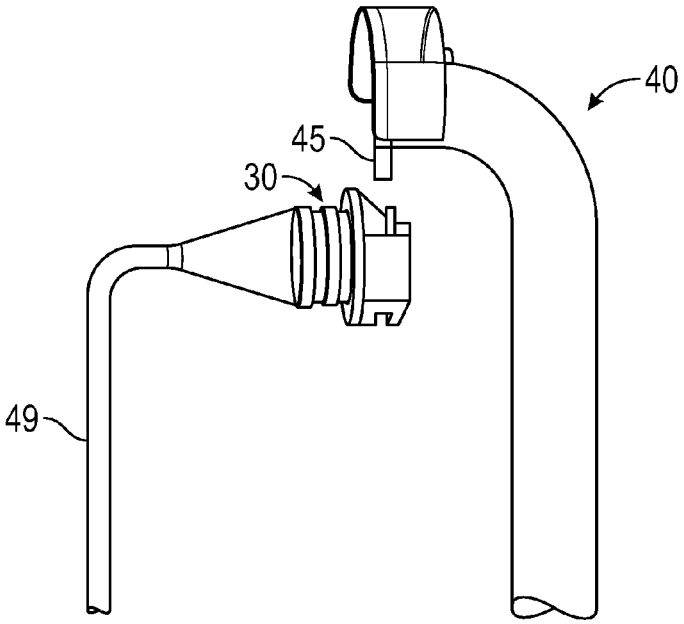
FIG. 7. Illustrates the arrangement of FIG. 6 but with a grout filling tool having been raised or lifted out of engagement with the installation fitting.
Figure 8:
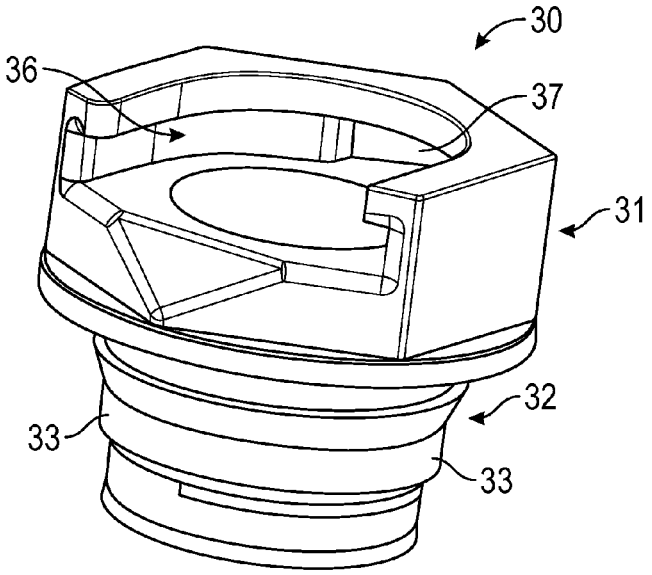
FIGS. 8-10. Illustrate the installation fitting which is attached to the upper part of the outer member.
Figure 9:
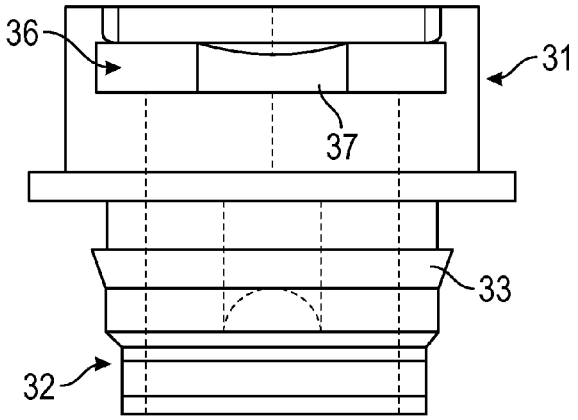
Figure 10:
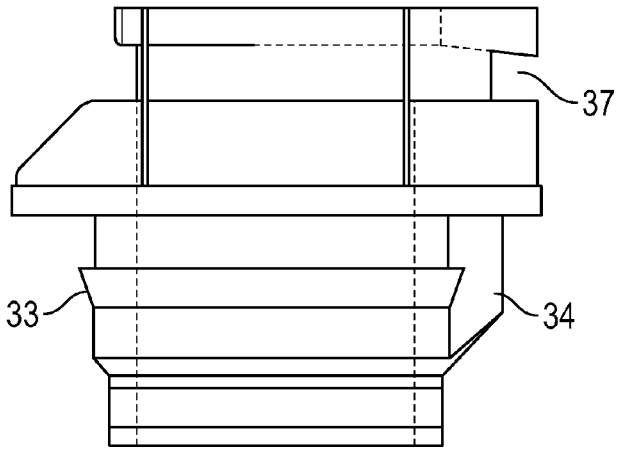

Reference will now be had to the grout filling tool 40 partially illustrated in FIGS. 4-5 and FIG. 7 and better illustrated in FIG. 6. The grout filling tool 40 comprises a rigid pipe 41 which can have a length of between 1.5-3 m. The lower end 42 of pipe 41 is attached to a grout hose (the grout hose can be of conventional design). The upper end of pipe 41 curves from the vertical to the horizontal and contains a coupling 43 of particular shape. Coupling 43 is better illustrated in FIG. 4 and comprises a laterally extending flange or lip 44 and a downwardly projecting key 45. Above and partially around coupling 43 is a protective shroud 46 to protect against grout splatter. The protective shroud 46 protects the worker on the ground from grout spraying between the two mating surfaces and falling onto the worker. Shroud 46 is shaped so that any grout leak will be contained with the shroud absorbing the energy and directing the grout to run down the side of the prop as opposed to being sprayed away from the prop. It is considered that this arrangement is safer in use.

In use, the grout filling tool (and particularly the rigid pipe portion 41) can be gripped by a worker and, while the worker is standing on the ground, can be lifted to the position illustrated in FIG. 4 where the coupling 43 sits just above the installation fitting 30. The worker then lowers the grout filling tool (see FIG. 5) such that the lip 44 passes into guide 36 on the installation fitting 30 and the projecting key 45 on the coupling of the grout filling tool passes through opening 37 at the bottom of the installation fitting 30. The worker can then let go of the grout filling tool and the weight of the tool will cause the coupling to sit hard against the installation fitting. Grout can then be pumped through the grout filling tool 40 and through the installation fitting and into the extended prop (see for instance 1E in FIG. 13, or FIG. 14).

The installation fitting 30 needs to be in the correct orientation when snap fitted into the wall of the prop and this is the reason why the installation fitting has the fin 34. In the correct orientation, the grout filling tool 40 can be simply lifted slightly above the installation fitting (FIG. 4) and then lowered into engagement (FIG. 5). Thus, it is no longer necessary to use a ladder to attach the grout hose to the prop.

Upon completion of the filling process, all that is necessary is for the worker to lift the grout filling tool back out of engagement with the installation fitting (that is movement from the position illustrated in FIG. 5 to the position illustrated in FIG. 4). Again, it is not necessary to use a ladder to detach the grout hose from the prop.

The coupling 43 on the grout filling tool 40 is designed to allow the grout filling tool to slide straight down into the correct position on the installation fitting 30. The installation fitting 30 has a tapered/ramped positioning slot in the bottom edge that allows a matching tapered/ramped positioning portion or dowel on the coupling to slide down and apply pressure to the face of the coupling against a matching face of the installation fitting to cause a semi-seal.

Figure 15:
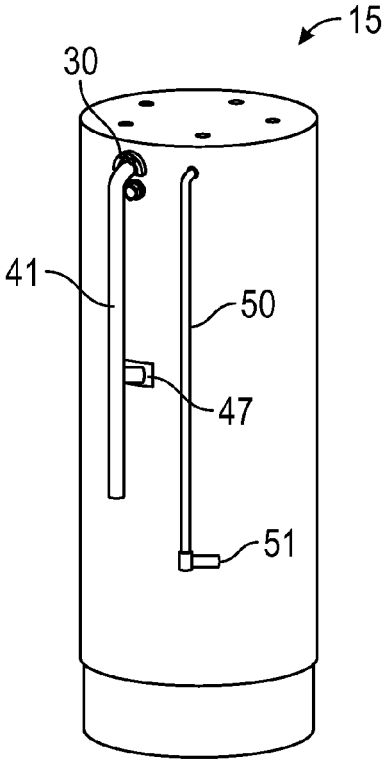
FIGS. 15-17. Illustrate the prop and the prop being filled.

The grout filling tool 40 and particularly the pipe part 41 contains a positioning guide 47 (see for instance FIG. 6 and FIG. 15) which is designed to maintain the correct position of the tool in the installation fitting during the filling process. To explain, as the prop is filled with grout, the center diameter will increase slightly (bulge) and the positioning guide 47 will allow for the change while maintaining the tool in the correct position in comparison to the installation fitting 30.

In a variation, the grout filling tool 40 can have a dual function which includes being able to supply compressed air into the prop to extend the prop from the retracted position to the extended position. In this variation, the prop is extended using compressed air as opposed to being lifted by two workers.

The installation fitting is provided with a backflow prevention valve/one-way valve. This prevents grout from spewing out of the installation fitting once the prop has been fully filled as this will cause a void to be created in the prop which can create weakness.

The one-way valve, in the present embodiment, comprises a length of lay flat plastic 49 having a diameter of about 100 mm and a length of about 1.5 m. One end of the plastic is attached to the inside portion of the installation fitting (see for instance FIG. 7) and can be held in place by a cable tie, clamp, tape, some form of adhesive, or can simply be held in place by being stretched fitted over the body portion 32 of the installation fitting. Thus, prior to the installation fitting being snapped fitted to the outer member 9, the lay flat plastic 49 is first attached to the installation fitting and is then fed through the grout inlet 17 to dangle inside the prop. The installation fitting is then snapped fitted in place.

As grout is pumped into the prop, the grout will travel through the plastic 49 and will cause the plastic to be inflated. As soon as the pumping stops, the plastic can return back to the deflated normal flat position stopping the reverse flow of the grout. Another advantage of the plastic is that it will cause the grout to flow down into the prop as opposed to being shot against the opposite wall of the prop. When the prop is filled, the plastic 49 and installation fitting 30 remain with the prop and the plastic 49 becomes embedded in the grout.

The plastic 49 can also function as a one-way valve for the use of compressed air to extend the prop.

The prop can be filled with a suitable grout material. It is envisaged that the flow rate will be approximately 165 L per minute although this can vary to suit. This enables the prop to be filled in approximately 12 min. This of course can vary and it is envisaged that different customers will have different requirements for the amount of weight that the prop need to hold for a desired amount of time and this can vary and the make up or strength of the grout to suit. A non-limiting grout that may be suitable for some applications is CMT Grout 1:1 water/powder ratio manufactured by Minova Australia.

During the filling process, small air holes in the top of the prop allow air to escape from the inside of the prop as it is being displaced by the grout being pumped into the prop. These openings can also be designed to enable some grout to pass through the openings when the prop is full to provide a visual confirmation that the prop is full of grout and the grout filling tool can then be switched off and removed.

Additional bleed lines or bleed openings may be provided. For instance, and referring to FIG. 15, there is provided a bleed line 50 communicating with an upper part of the prop and the lower end of which contains a valve 51 to regulate the amount of air.

Figure 16:
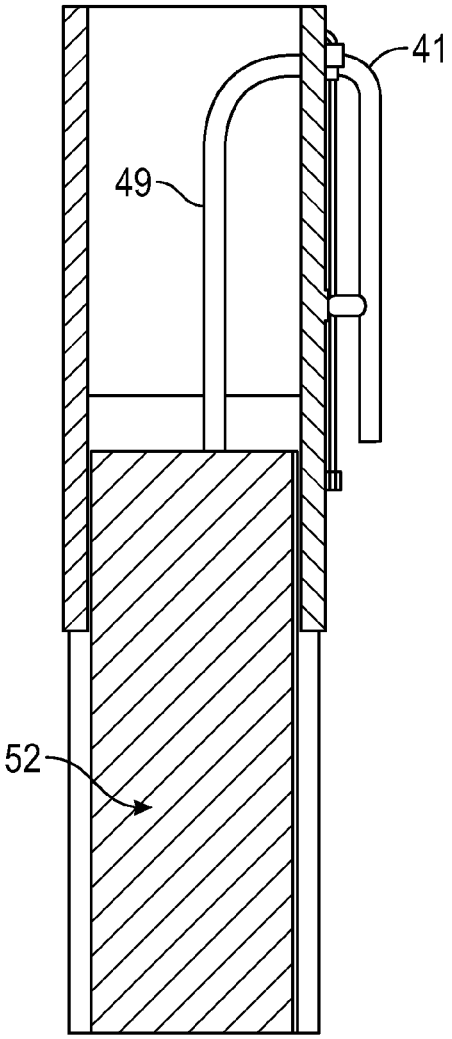
Figure 17:
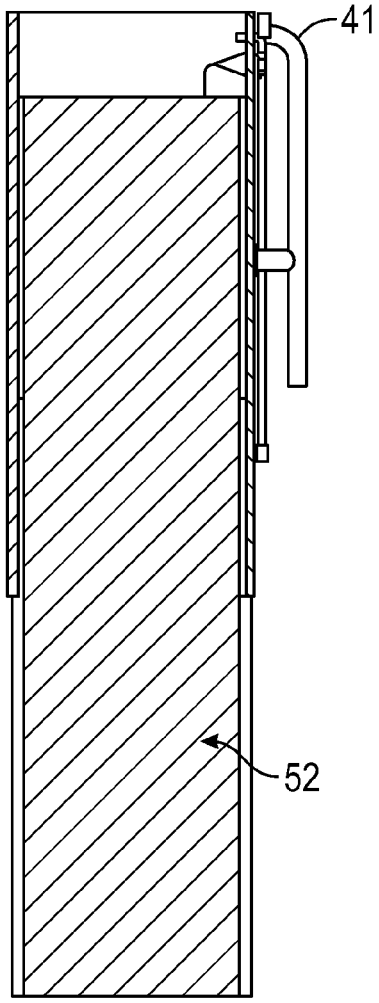

FIG. 16 illustrates the prop in the process of being filled with grout 52, and FIG. 17 illustrates the prop almost full of grout 52.

Once the prop has been filled with grout, the grout filling tool can be lifted off the installation fitting and then be placed on a second prop for filling. In this manner, multiple props can be filled with grout in a safe, simple and convenient manner. That is, all tasks can be carried out from the safety of ground level.

By having the installation fitting 30 attached to the prop just before the prop is extended, there is virtually no possibility of the fitting being damaged and therefore unable to accommodate the grout filling tool.

Figure 18:
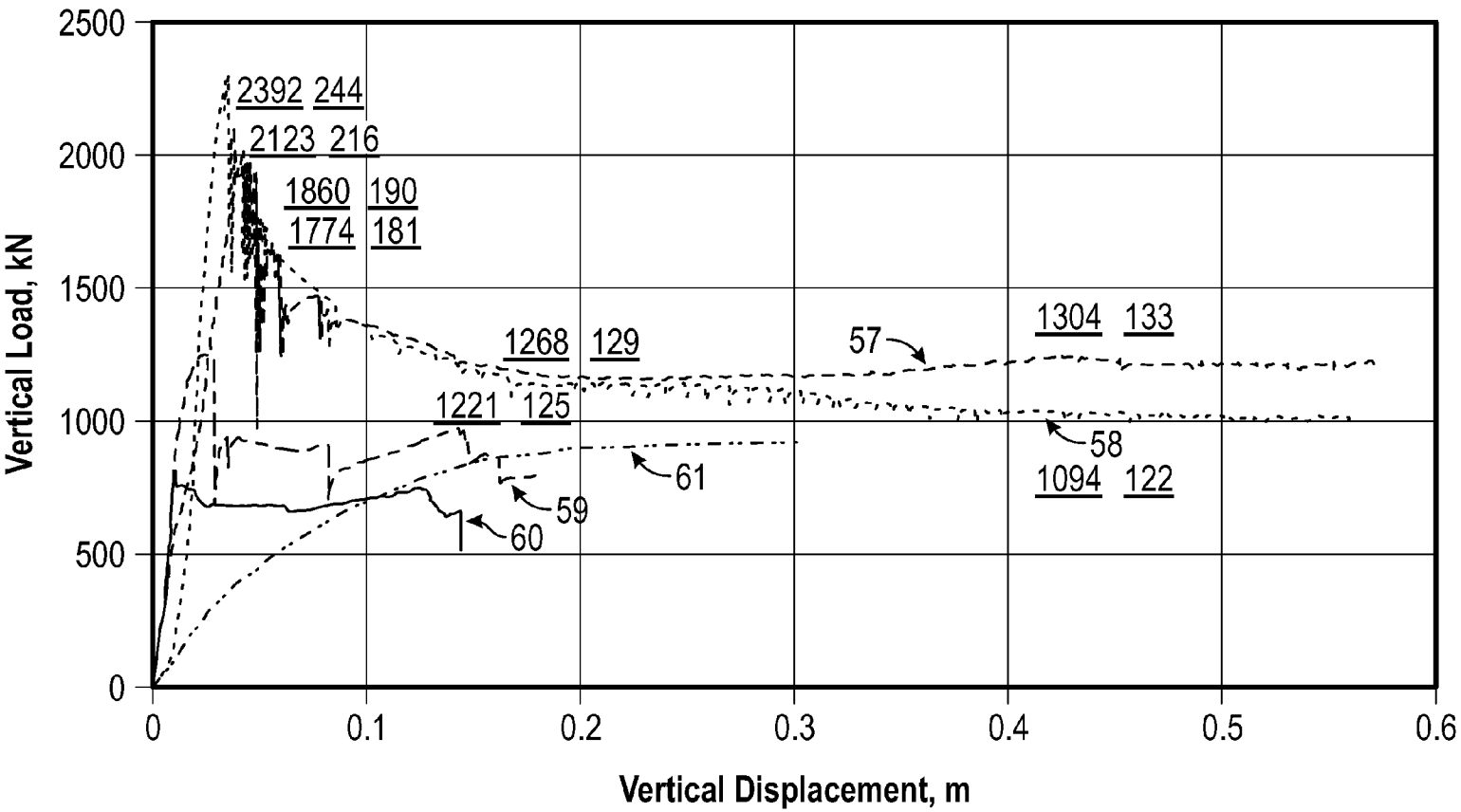
FIG. 18. Illustrates a graph showing the improved load bearing ability of the prop according to the present invention.
Figure 19:
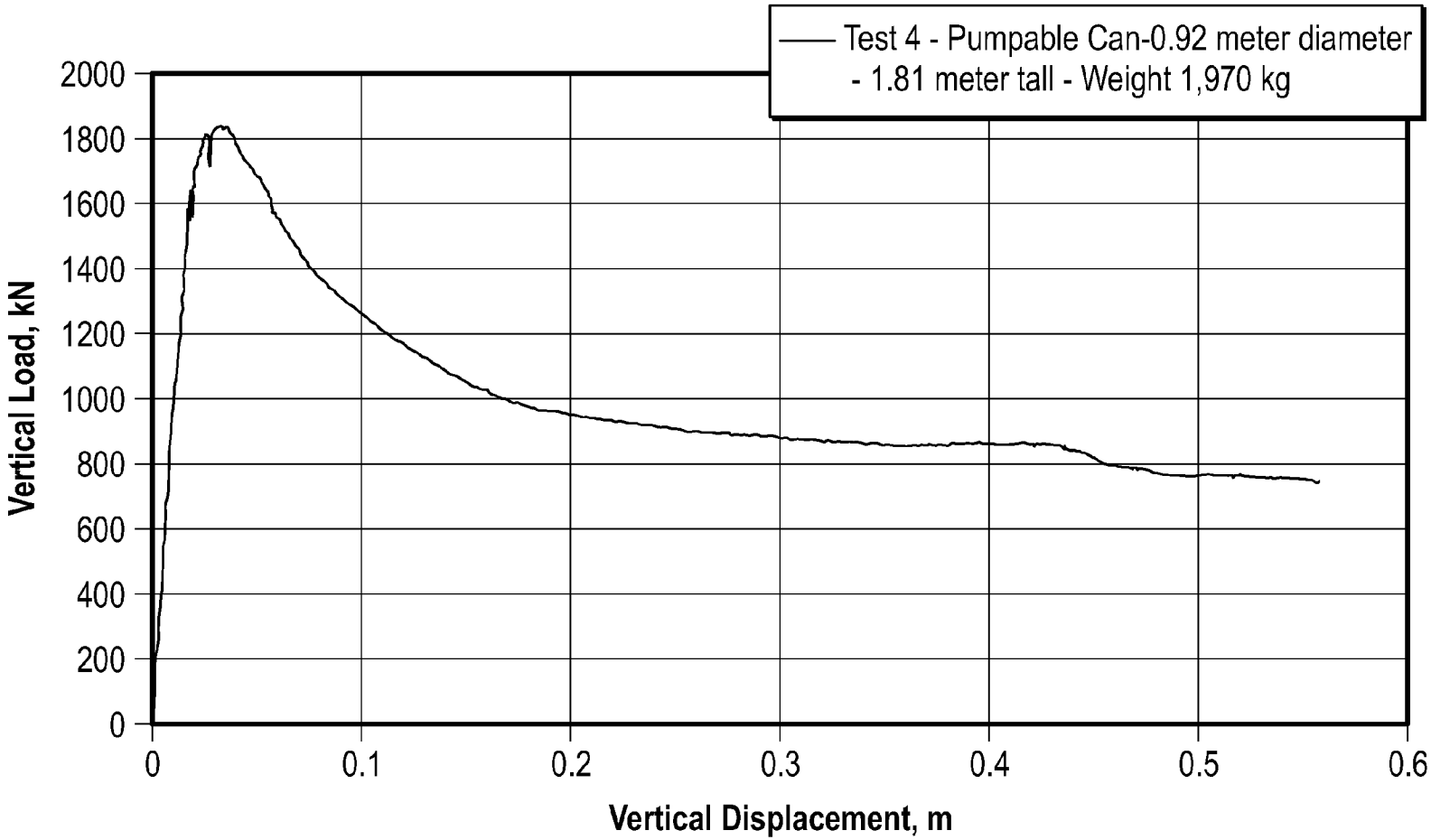
FIG. 19. Illustrates a graph of the vertical displacement ability of the prop of the present invention.

The surprising and unexpected improvement to the load bearing capability of the prop can be summarised in FIGS. 18 and 19. To explain, while it is important that prop is capable of supporting a load without failure, it is just as important that the prop can maintain its load supporting properties while being crushed down. Thus, should a mine roof collapse or buckle, the supporting props will be crushed down (this being called vertical displacement of the props), and notwithstanding the crushing process, the props should maintain adequate load supporting properties for as long as possible before failing.

Referring to FIG. 18, lines 57 and 58 comprise two tests of the prop according to the present invention, lines 59 and 60 comprise two tests of a crib bag prop of conventional design, and line 61 comprises a test of a 24 inch diameter steel prop (all props being filled with grout). Again, it can clearly be seen that the props according to the present invention (57,58) can be crushed down (vertically displaced) by more than half a meter before failing which is much better than the other props which fail after about 150 mm of crushing or about 300 mm of crushing.

FIG. 19 illustrates a prop according to the present invention having a diameter of 920 mm, a height of 1.81 m and a filled weight of 1,970 kg. the prop can be crushed down (vertical displacement) over ½ a meter while still able to bear a load of about 800 kN (about 81 tons!). Thus the prop can be crushed down by over 25% of its original length before failing.

It appears that the combination of a prop having walls of plastic properties and grout is much better able to be crushed while retaining the grout than is the case with crib bags or even steel tubes. While not wishing to be bound by theory it appears that the plastic properties of the walls of the prop can accommodate the crushed down grout by bulging, stretching and otherwise accommodating the crushed down forces without spilling the grout until such time as the prop has been crushed down by over half a meter.

It will be realized that the prop described with reference to the figures is easily transportable in the collapsed state since it is light and relatively compact. Several such props can be loaded onto a truck to be transported and installed on site.

It will be further understood that the dimensions and proportions of the prop may be varied from that of the particular embodiment described herein. Furthermore, a prop of non-circular cross-section, e.g. square or rectangular section, might be used in some embodiments.

Where it is envisaged that the prop be used in a mining environment it will preferably be made of, or treated with, an anti-static material.

In compliance with the statute, the invention has been described in language more or less specific to structural or methodical features. The term "comprises" and its variations, such as "comprising" and "comprised of" is used throughout in an inclusive sense and not to the exclusion of any additional features. It is to be understood that the invention is not limited to specific features shown or described since the means herein described comprises preferred forms of putting the invention into effect. The invention is, therefore, claimed in any of its forms or modifications within the proper scope of the appended claims appropriately interpreted by those skilled in the art.

What is claimed is:

1. A grout fillable prop comprising an inner member and an outer member adapted for movement between an extended use position and a retracted position, a grout inlet in an upper part of a sidewall of the outer member to allow grout to pass into the prop, the inner member and the outer member having wall portions with plastic properties and being self-supporting, the prop further including an installation fitting fitted to the grout inlet and adapted to hold a grout filling tool without the use of separate fasteners, and a one way valve fitted to the installation fitting, the one way valve comprising a length of lay flat hose one end of which is attached to the installation fitting, the hose locatable inside the prop when the installation fitting is attached to the prop.

2. The prop of claim 1, the installation fitting having a guide adapted to capture a coupling on the tool and an opening adapted to accommodate a key on the tool, the installation fitting enabling the tool to be lifted into and out of engagement with the fitting.

3. The prop of claim 2, wherein the installation fitting is adapted to push lock into the grout inlet without the use of separate fasteners.

4. The prop of claim 3, wherein the installation fitting has an outer head portion containing the guide and opening, and an inner body portion adapted to be pushed into the grout inlet, the body portion comprising push locking means to lock the body portion to the outer member when the fitting is pushed into the grout inlet.

5. The prop of claim 2, comprising a fin shaped dowel on the installation fitting to locate the installation fitting in the correct position on the outer member.

6. The prop of claim 1 including air holes to enable air in the prop to escape as grout is pumped in.

7. The prop of claim 1, wherein the outer member includes a top wall and an opening in the top wall adapted to accommodate a roof bolt.

8. The prop of claim 1 having an extended length of between 2.5-6 meters and a diameter of between 50-200 cm.

9. The prop of claim 8 wherein the inner member and the outer member comprise thermoplastic polymer and have a sidewall thickness of between 2-10 mm.

10. The prop of claim 1 filled with grout and able to accommodate a vertical displacement of at least 25% of the length of the prop before failing.

11. A grout fillable prop comprising an inner member and an outer member adapted for movement between an extended use position and a retracted position, a grout inlet in an upper part of a sidewall of the outer member to allow grout to pass into the prop, the inner member and the outer member having wall portions with plastic properties and being self-supporting, an installation fitting fitted to the grout inlet and adapted to hold a grout filling tool without the use of separate fasteners, the installation fitting having a guide adapted to capture a coupling on the tool and an opening adapted to accommodate a key on the tool, the installation fitting enabling the tool to be lifted into and out of engagement with the fitting, a one way valve fitted to the installation fitting, the one way valve comprising a length of lay flat hose one end of which is attached to the installation fitting, the hose locatable inside the prop when the installation fitting is attached to the prop, and a grout filling tool having an elongate pipe portion having a lower end adapted to connect to a grout hose and an upper end containing a coupling which has an outwardly extending flange adapted to be captured by the guide on the installation fitting and a depending key adapted to pass through the opening in the installation fitting, wherein the tool is adapted to be lowered into engagement with the installation fitting to enable grout to be pumped into the prop and is adapted to be lifted out of engagement with the installation fitting after the prop is filled with grout.

12. A grout filling tool for pumping grout into a grout fillable prop comprising an inner member and an outer member adapted for movement between an extended use position and a retracted position a grout inlet in an upper part of a sidewall of the outer member to allow grout to pass into the prop the inner member and the outer member having wall portions with plastic properties and being self-supporting, the grout filling tool having an elongate pipe portion having a lower end adapted to connect to a grout hose and an upper end containing a coupling which has an outwardly extending flange and a depending key, the tool adapted to be lowered into engagement with an installation fitting on the grout inlet to enable grout to be pumped into the prop and adapted to be lifted out of engagement with the installation fitting after the prop is filled with grout, and wherein the installation fitting includes a one way valve fitted to the installation fitting, the one way valve comprising a length of lay flat hose one end of which is attached to the installation fitting, the hose locatable inside the prop when the installation fitting is attached to the prop.

13. The tool of claim 12, including a positioning guide extending from the pipe portion and adapted to abut against the prop sidewall to space the pipe portion from the sidewall.

* * * * *